US009757958B2

(12) United States Patent
Saikawa

(10) Patent No.: US 9,757,958 B2
(45) Date of Patent: Sep. 12, 2017

(54) CONTROL METHOD OF A PRINTING DEVICE, AND PRINTING DEVICE

(71) Applicant: Seiko Epson Corporation, Tokyo (JP)

(72) Inventor: Takashi Saikawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/253,380

(22) Filed: Aug. 31, 2016

(65) Prior Publication Data

US 2017/0057259 A1 Mar. 2, 2017

(30) Foreign Application Priority Data

Sep. 1, 2015 (JP) ..... 2015-171731

(51) Int. Cl.

| | |
|---|---|
| ***B41J 3/407*** | (2006.01) |
| ***B41J 11/00*** | (2006.01) |
| ***B41J 11/46*** | (2006.01) |
| *B41J 11/42* | (2006.01) |
| *B41J 29/38* | (2006.01) |

(52) U.S. Cl.

CPC ..... *B41J 3/4075* (2013.01); *B41J 11/008* (2013.01); *B41J 11/0095* (2013.01); *B41J 11/46* (2013.01); *B41J 11/42* (2013.01); *B41J 29/38* (2013.01)

(58) Field of Classification Search

None

See application file for complete search history.

(56) References Cited

U.S. PATENT DOCUMENTS

| | | | | |
|---|---|---|---|---|
| 2009/0102878 | A1 | 4/2009 | Yamada | |
| 2010/0074635 | A1 | 3/2010 | Sakurai | |
| 2011/0311292 | A1 | 12/2011 | Yamada | |
| 2012/0133959 | A1 * | 5/2012 | Shibahara | G03G 15/5029 358/1.2 |

FOREIGN PATENT DOCUMENTS

| | | | |
|---|---|---|---|
| JP | 2008-238484 | A | 10/2008 |
| JP | 2009-102097 | A | 5/2009 |

* cited by examiner

*Primary Examiner* — Lisa M Solomon

(74) *Attorney, Agent, or Firm* — Nutter McClennen & Fish LLP; John J. Penny, Jr.

(57) ABSTRACT

A printer that conveys label paper or black mark paper executes an appropriate process when conveying paper that has been spliced. While conveying label paper or black mark paper by the conveyance unit 42, the inkjet printer 5 calculates the interval at which the labels or marks are disposed based on detecting the label edges or marks by a sensor disposed to the conveyance path. An error is detected if the calculated interval is shorter than a specified length. If the calculated interval is longer than the specified length, the calculated interval is compared with the previously calculated interval. If the previously calculated interval is the same as the specified length, an error is not detected. If the previously calculated interval is longer than the specified length, an error is detected.

8 Claims, 7 Drawing Sheets

CONTROL METHOD OF A PRINTING DEVICE, AND PRINTING DEVICE

BACKGROUND

1. Technical Field

The present invention relates to a control method of a printing device, and a printing device.

2. Related Art

Printing devices (printers) that convey label paper (recording media) having labels affixed at a constant interval to a liner (backing paper) and print on the labels, and detect the gap between liner and the labels with a sensor while conveying the label paper are known from the literature. See, for example, JP-A-2008-238484. Some printers such as described in JP-A-2008-238484 that detect the gap between the liner and labels also detect the label interval (the interval at which labels are affixed) based on the detected gap, and based on the detected label interval determine if an error has occurred, such as if the correct type of label paper is not loaded or if the label paper is not being conveyed normally. The printer normally stops printing if it is determined that an error occurred because printing normally may not be possible.

Some printers that convey and print on paper with black marks preprinted at a specific interval detect the mark interval, which is the interval between one black mark and the next, with a sensor while conveying the paper. Based on the detected mark interval, some printers of this type determine if an error has occurred, such as if the correct type of marked paper is loaded or if the marked paper is conveyed normally, based on the detected mark interval. When an error is detected, the printer stops printing because normal printing may not be possible.

The label interval on a single length of label paper is a specific constant length, and the mark interval on a single length of marked paper is also a specific constant length. However, the manufacturer or the user may splice together different pieces of label paper or marked paper, and after splicing, the label interval or the mark interval may differ from the specified interval length where the paper is spliced. When such spliced paper is used for printing, the printers cited above will reliably detect an error and stop printing. There is, therefore, a need for a printer to execute an appropriate process so that printing does not stop unnecessarily and enable the printer to continue printing normally when spliced paper is used.

SUMMARY

A printer capable of conveying label paper or black mark paper according to the invention executes a process for desirably handling conveyance of spliced paper.

To achieve the foregoing objective, a control method of a printing device having a conveyance unit configured to convey label paper with labels affixed at a specific interval to a liner, or marked paper having marks printed at a specific interval, and a printhead configured to print on the label paper or the marked paper conveyed by the conveyance unit, includes: detecting the label interval, which is the interval at which adjacent labels are affixed to the label paper, or the mark interval, which is the interval at which the marks are printed on marked paper, by a sensor disposed to the conveyance path while conveying the label paper or marked paper by the conveyance unit; determining there is an error if the label interval or the mark interval is shorter than a specified length; not determining an error occurred if, after a label interval or mark interval longer than the specified length is detected, the next-detected label interval or mark interval is longer the specified length; and determining an error occurred if, after a label interval or mark interval longer than the specified length is detected, the next-detected label interval or mark interval is longer than the specified length.

A printing device able to convey label paper or marked paper according to this configuration can execute a process appropriate to conveying paper that has been spliced.

In another aspect of the invention, the paper is the same type of label paper or marked paper that has been spliced, and the label interval or mark interval at the splice in the paper is longer than the specified length.

A printing device able to convey label paper or marked paper according to this configuration can execute a process appropriate to conveying paper that has been spliced.

Another aspect of the invention sets the specified length according to a command from operation of an operating switch or a control command from an external device, or detects the label interval or mark interval detected by a specific process, and sets the detected label interval or mark interval as the specified length.

This configuration can set a specified length of an appropriate value.

Another aspect of the invention is characterized by the printhead being disposed downstream from the sensor in the conveyance direction; printing by the printhead while conveying the label paper or the marked paper in the conveyance direction by the conveyance unit; and detecting the label interval or the mark interval by optically detecting the marks or an edge of the labels on the liner by a sensor.

This configuration can accurately detect the label interval or mark interval while printing with the printhead.

Another aspect of the invention is a printing device having a conveyance unit configured to convey label paper with labels affixed at a specific interval to a liner, or marked paper having marks printed at a specific interval; a printhead configured to print on the label paper or the marked paper conveyed by the conveyance unit; and a controller. The controller detects the label interval, which is the interval at which adjacent labels are affixed to the label paper, or the mark interval, which is the interval at which the marks are printed on marked paper, by a sensor disposed to the conveyance path while conveying the label paper or marked paper by the conveyance unit; determines there is an error if the label interval or the mark interval is shorter than a specified length; does not determine an error occurred if, after a label interval or mark interval longer than the specified length is detected, the next-detected label interval or mark interval is longer the specified length; and determines an error occurred if, after a label interval or mark interval longer than the specified length is detected, the next-detected label interval or mark interval is longer than the specified length.

A printing device able to convey label paper or marked paper according to this configuration can execute a process appropriate to conveying paper that has been spliced.

Other objects and attainments together with a fuller understanding of the invention will become apparent and appreciated by referring to the following description and claims taken in conjunction with the accompanying drawings.

DESCRIPTION OF EMBODIMENTS

A preferred embodiment of the present invention is described below with reference to the accompanying figures.

Figure 1:
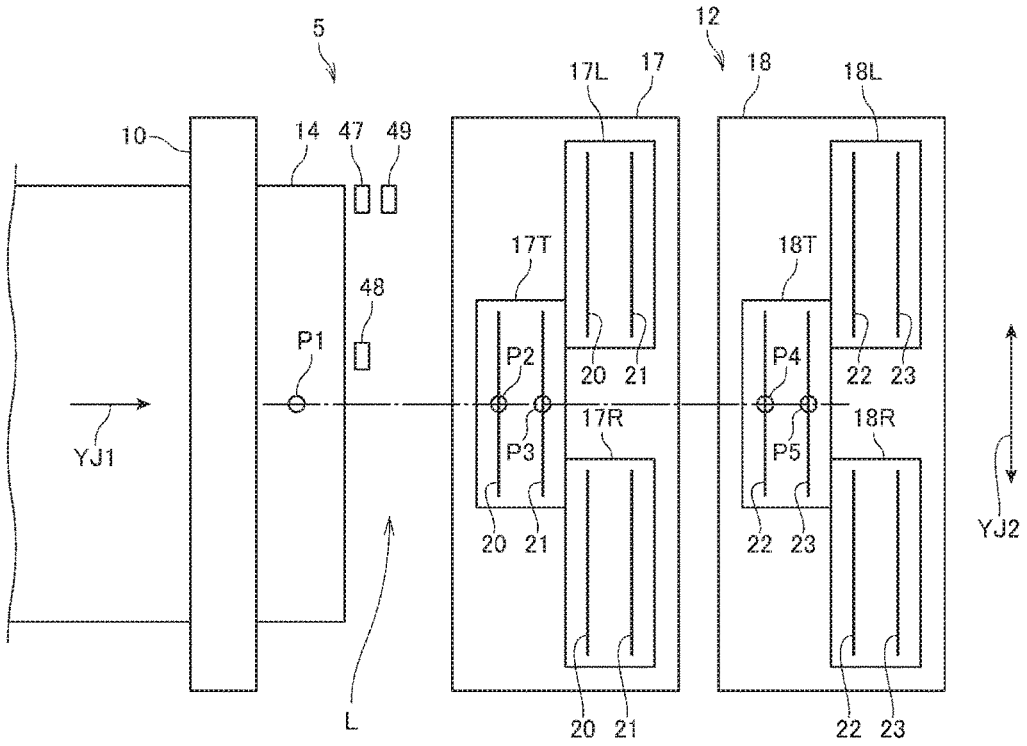
FIG. 1 illustrates an inkjet printer according to an embodiment of the invention.

FIG. 1 schematically illustrates the configuration of the print mechanism of an inkjet printer 5 (printing device) according to a preferred embodiment of the invention.

The inkjet printer 5 is a inkjet line printer that drives a conveyance roller 10 to convey paper 14 in the conveyance direction YJ1 and discharges ink from an inkjet line head 12 (printhead) onto the conveyed paper 14 to print images on the paper 14.

FIGS. 2A-2D illustrate paper 14 that may be used in the inkjet printer 5.

At least one of the recording media shown in FIG. 2A, FIG. 2B, FIG. 2C, and FIG. 2D is used as the paper 14 in the inkjet printer 5 according to this embodiment. Detected parts that are detected by a black mark sensor 47, gap sensor 48, or notch sensor 49 described below are disposed at a specific interval on the recording media.

Figure 2A:
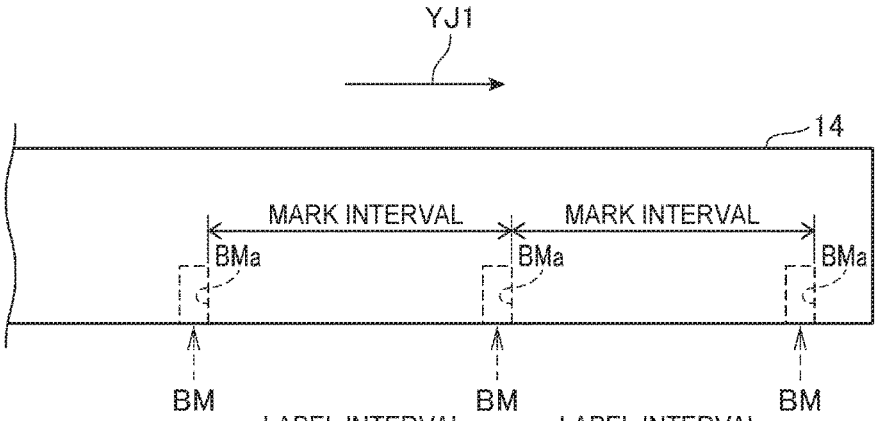
FIGS. 2A-2D show examples of paper.

FIG. 2A shows an example of paper 14 that is used in the inkjet printer 5. The paper 14 shown in FIG. 2A is black mark paper that is continuous paper and has black marks BM printed at a specific interval on the back as the detected parts. The area on the front of paper 14 in FIG. 2A is the area were dots are formed and images are printed except in the margins.

Figure 2B:
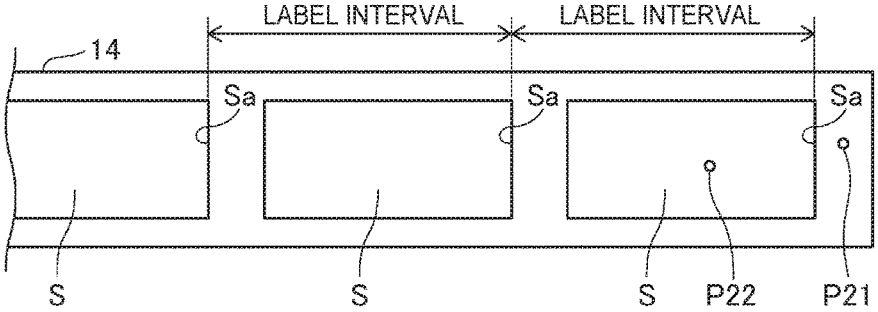

FIG. 2B shows another example of paper 14. The paper 14 shown in FIG. 2B is label paper having labels S affixed at a specific interval on the surface of a continuous liner. The labels S are die-cut seals, and can be peeled by the user from the liner along the borders in the waste matrix. The length of each label S in the longitudinal direction is constant, and the interval at which the labels S are affixed is also constant. The area corresponding to each label S in the paper 14 shown in FIG. 2B is the area where dots are formed and images are printed. The detected parts of the paper 14 shown in FIG. 2B is one end (Sa) of each affixed label in the conveyance direction.

Figure 2C:
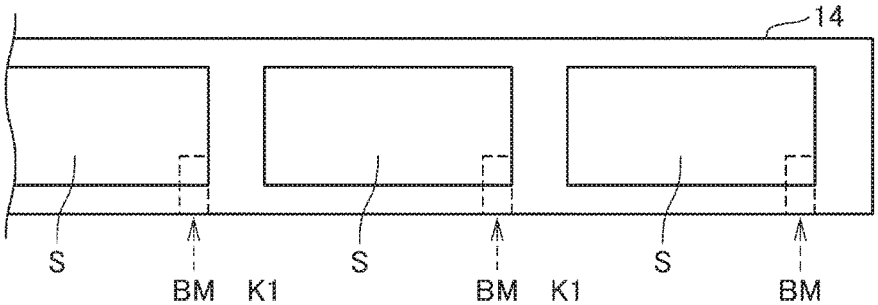

FIG. 2C shows another example of paper 14. The paper 14 shown in FIG. 2C is an example of black mark label paper having labels S affixed at a specific interval on the front, and black marks BM (marks) printed as detected parts on the back of the paper 14 at the same interval as the interval at which the labels S are affixed.

Figure 2D:
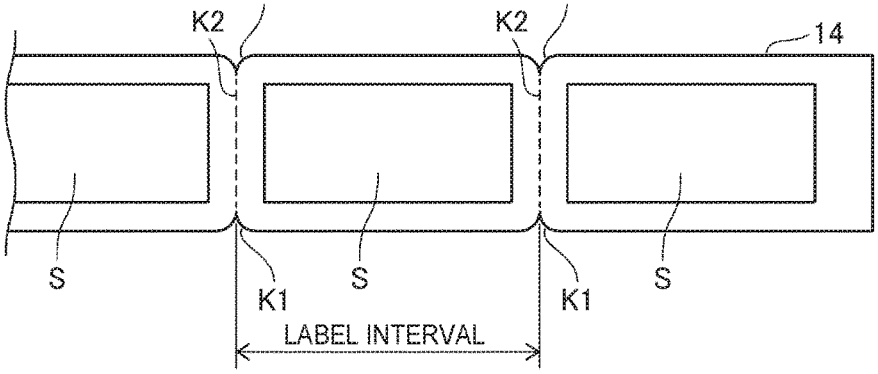

FIG. 2D shows another example of paper 14. The paper 14 shown in FIG. 2D is label paper having labels S affixed to the front of the paper 14. Black marks BM are not printed on the back of the paper 14. The paper 14 shown in FIG. 2D has two notches K1 (detected parts) formed as the detected parts on opposite sides of the width (short side) of the paper 14 between one label S and the next label S. A perforated line K2 connecting two opposing notches K1 is formed in the paper 14 shown in FIG. 2D, enabling the user to easily tear the paper 14 at the perforated line K2.

Four types of paper 14 are shown as examples of paper 14 used in the inkjet printer 5, but the paper 14 used in the inkjet printer 5 is not limited to these examples.

When paper 14 is set in the inkjet printer 5, the length of the set paper 14 corresponds to the conveyance direction YJ1. The inkjet printer 5 prints images on the labels S while conveying the paper 14 in the conveyance direction YJ1.

The inkjet printer 5 shown in FIG. 1 is an inkjet line printer having an upstream head unit 17 and a downstream head unit 18.

The upstream head unit 17 has three staggered printheads, upstream top printhead 17T, upstream left printhead 17L, and upstream right printhead 17R. The downstream head unit 18 likewise has three staggered recording heads, downstream top printhead 18T, downstream left printhead 18L, and downstream right printhead 18R.

A black nozzle row 20, and a cyan nozzle row 21 disposed downstream from the black nozzle row 20, are disposed to the upstream top printhead 17T.

The black nozzle row 20 is a nozzle row having nozzles (not shown) that eject ink as fine ink droplets formed in the nozzle row direction YJ2, which is perpendicular to the conveyance direction YJ1. Ink is supplied to the black nozzle row 20 from a black (K) ink cartridge (not shown). The upstream top printhead 17T drives an actuator such as a piezoelectric device to push ink out toward the paper 14, ejecting fine ink droplets from specific nozzles.

Like the black nozzle row 20, the cyan nozzle row 21 is a nozzle row of nozzles formed in the nozzle row direction YJ2, and ink is supplied thereto from a cyan (C) ink cartridge (not shown).

The upstream right printhead 17R and the upstream left printhead 17L are configured identically to the upstream top printhead 17T, and each has a black nozzle row 20, and a cyan nozzle row 21 disposed on the downstream side of the black nozzle row 20.

A magenta nozzle row 22, and a yellow nozzle row 23 located downstream from the magenta nozzle row 22, are disposed to the downstream top printhead 18T.

Like the black nozzle row 20, the magenta nozzle row 22 is a row of nozzles formed in the nozzle row direction YJ2, and has ink supplied from a magenta (M) ink cartridge (not shown).

Like the black nozzle row 20, the yellow nozzle row 23 is also a row of nozzles formed in the nozzle row direction YJ2, and has ink supplied from a yellow (Y) ink cartridge (not shown).

The downstream right printhead 18R and downstream left printhead 18L are configured identically to the downstream top printhead 18T, and each has a magenta nozzle row 22 and a yellow nozzle row 23 disposed on the downstream side of the magenta nozzle row 22.

Note that the printheads and the nozzle rows of the recording heads are shown in FIG. 1 for convenience of description, and are actually configured to eject ink vertically downward from the nozzles of the nozzle rows, and parts are disposed to achieve this configuration.

The inkjet printer 5 ejects ink and forms dots on the paper 14, and print s images by the combination of dots. The basic operation forming a single dot on the paper 14 is described below using FIG. 1.

Forming a dot of a specific color at position P1 on the paper 14 when the paper 14 is set to the position shown in FIG. 1 is described below. The specific color in this example is a color that is produced by ejecting specific amounts of black (K), cyan (C), magenta (M), and yellow (Y) ink. In FIG. 1, position P2 is the position where position P1 on the conveyed recording medium passes the black nozzle row 20 of the upstream top printhead 17T. Position P3, position P4, and position P5 are similar positions.

The inkjet printer 5 conveys the paper 14 in the conveyance direction YJ1 at a substantially constant speed while forming dots on the paper 14. Conveyance of the paper 14 in the conveyance direction YJ1 proceeds from the position shown in FIG. 1, and the inkjet printer 5 ejects a specific amount of black (K) ink from the nozzle corresponding to position P2 timed to position P1 on the paper 14 reaching the position corresponding to position P2. The inkjet printer 5 likewise ejects a specific amount of cyan (C) ink from the nozzle corresponding to position P3 timed to position P1 on the paper 14 reaching the position corresponding to position P3; ejects a specific amount of magenta (M) ink from the nozzle corresponding to position P4 timed to position P1 on the paper 14 reaching the position corresponding to position P4; and ejects a specific amount of yellow (Y) ink from the nozzle corresponding to position P5 timed to position P1 on the paper 14 reaching the position corresponding to position P5.

Specific amounts of black (K), cyan (C), magenta (M), and yellow (Y) ink are thus ejected to position P1 on the paper 14, and a dot of a specific color is formed at position P1.

With an inkjet printer 5 according to this embodiment of the invention, the position of the inkjet line head 12 is fixed during the image printing process, the paper 14 moves at a constant speed relative to the stationary inkjet line head 12, ink is desirably ejected from the inkjet line head 12 to form dots, and an image is printed.

Figure 3:
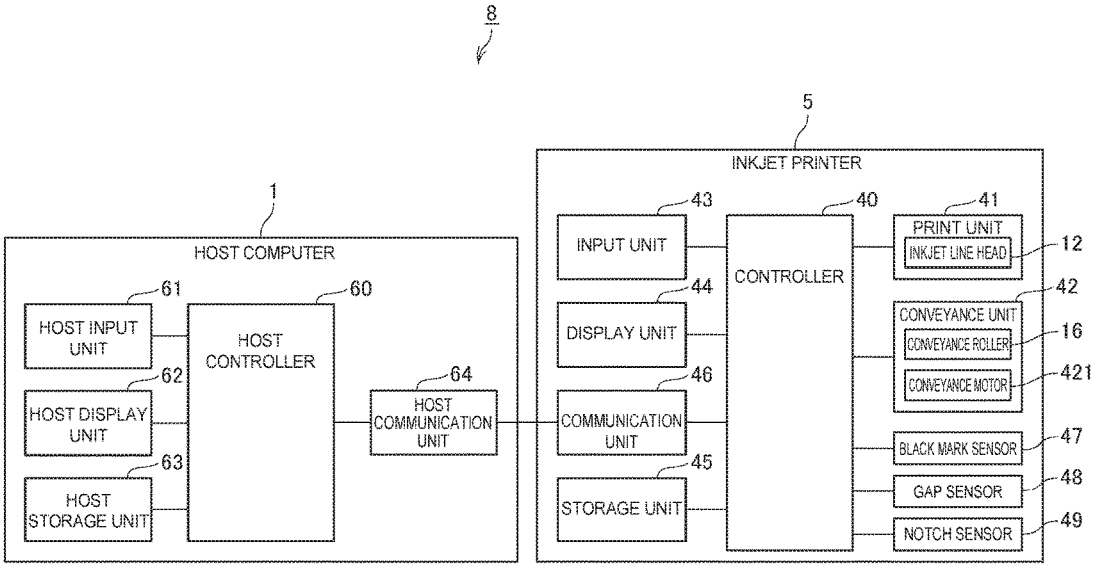
FIG. 3 is a block diagram illustrating the functional configuration of a host computer and inkjet printer.

FIG. 3 schematically illustrates the functional configuration of a printing system 8 according to this embodiment of the invention.

As shown in FIG. 3, the printing system 8 includes an inkjet printer 5, and a host computer 1 (control device) that can connect to the inkjet printer 5 and controls the inkjet printer 5.

As shown in FIG. 3, the inkjet printer 5 has a controller 40, print unit 41, conveyance unit 42, input unit 43, display unit 44, storage unit 45, communication unit 46, black mark sensor 47, gap sensor 48, and notch sensor 49.

The controller 40 comprises a CPU, ROM, RAM, and other peripheral circuits, and the CPU controls the inkjet printer 5 through hardware and software, such as the CPU reading and running a control program.

The print unit 41 includes the inkjet line head 12, a drive circuit that drives the inkjet line head 12, and other configurations related to printing on paper 14, and prints images on the paper 14 as controlled by the controller 40.

The conveyance unit 42 includes the conveyance roller 10 described above, a conveyance motor 421 that drives the conveyance roller 10, a motor driver that drives the conveyance motor 421, and other configurations related to conveying the paper 14, and conveys the paper 14 as controlled by the controller 40. The controller 40 controls the motor driver to drive the conveyance motor 421, turn the conveyance roller 10, and convey the paper 14. The conveyance motor 421 is a stepper motor, and the controller 40 manages the conveyance distance by the number of steps.

The input unit 43 includes operating switches disposed to the inkjet printer 5, detects operation of the operating switches, and outputs to the controller 40. The controller 40 manages the operates corresponding to the operation of the operating switches based on input from the input unit 43.

The display unit 44 includes multiple LEDs, and causes the LEDs to turn on and off in specific patterns as controlled by the controller 40 to indicate the condition of the inkjet printer 5 and the occurrence of errors. The display unit 44 may be configured with a display panel such as an LCD display panel.

The storage unit 45 has nonvolatile memory such as an EEPROM or hard disk drive, and rewritably stores data.

The communication unit 46 communicates according to a specific communication protocol with the host computer 1 as controlled by the controller 40.

The black mark sensor 47 is a reflective optical sensor disposed to a position corresponding to where the black marks BM printed on black mark paper pass when black mark paper is set in the inkjet printer 5 as the paper 14 and conveyed. As shown in FIG. 1, the black mark sensor 47 is disposed on the upstream side in the conveyance direction YJ1 from the inkjet line head 12 on the conveyance path L through which the paper 14 is conveyed. The black mark sensor 47 outputs a different detection value to the controller 40 according to whether or not a black mark BM is present at the position corresponding to the location of the black mark sensor 47.

The controller 40 detects if a black mark BM is present or is not present at the position of the sensor based on the detection value input from the black mark sensor 47. More specifically, based on the detection value input from the black mark sensor 47 during conveyance of the paper 14 (black mark paper), the controller 40 calculates the mark interval, which is the distance between consecutively printed black marks BM. Yet more specifically, while conveying the paper 14 (black mark paper), the controller 40 counts the number of steps the conveyance motor 421 is required to drive between detection of the leading edge BMa of one black mark BM on the conveyance direction YJ1 side and detection of the leading edge BMa of the black mark BM printed next after the one black mark BM on the upstream side in the conveyance direction YJ1, and calculates the mark interval between one black mark BM and the next black mark BM based on the number of steps. Triggered by detecting the leading edge BMa of a black mark BM, the controller 40 continues calculating the mark interval while conveying the paper 14 (black mark paper).

The gap sensor 48 is a transmissive optical sensor disposed to a position corresponding to where the labels S affixed to a liner pass when label paper as described above is set in the inkjet printer 5 as the paper 14 and conveyed. As shown in FIG. 1, the gap sensor 48 is disposed on the upstream side in the conveyance direction YJ1 from the inkjet line head 12 on the conveyance path L through which the paper 14 is conveyed. The gap sensor 48 outputs a different detection value to the controller 40 according to whether or not a label S is present at the position corresponding to the location of the sensor. More specifically, as shown in FIG. 2B, the transmittance of light output by a light-emitting unit of the gap sensor 48 differs where a label S is affixed to the label paper (such as position P22 in FIG. 2B) and where a label S is not affixed (such as position P21 in FIG. 2B). As a result, the intensity of light received by the photodetection part of the sensor changes according to whether or not a label S is at the position of the gap sensor 48. More specifically, the gap sensor 48 outputs a different detection value to the controller 40 based on change in the intensity of light detected by the photodetection part of the gap sensor 48.

The controller 40 calculates the label interval, which is the gap between adjacently affixed labels S, based on the detection value input from the gap sensor 48 while the paper 14 (label paper) is being conveyed. More specifically, as shown in FIG. 2B, while conveying the paper 14 (label paper), the controller 40 counts the number of steps the conveyance motor 421 is required to drive between detection of the leading edge Sa on one side of one label S in the conveyance direction YJ1 and detection of the leading edge Sa of the next label S affixed next after the one label S on the upstream side in the conveyance direction YJ1, and calculates the label interval between one label S and the next label S based on the number of steps. Triggered by detecting the leading edge Sa of a label S, the controller 40 continues calculating the label interval while conveying the paper 14 (label paper).

The notch sensor 49 is a transmissive optical sensor disposed to a position corresponding to where notches K1 formed in the paper 14 pass when paper 14 having notches K1 formed at a specific interval (referred to below as notched paper) as described above is set in the inkjet printer 5 as the paper 14 and conveyed. If notches K1 are formed in opposing pairs, the notch sensor 49 may be disposed to the position corresponding to only one of the notches K1. As shown in FIG. 1, the notch sensor 49 is disposed on the upstream side in the conveyance direction YJ1 from the inkjet line head 12 on the conveyance path L through which the paper 14 is conveyed. The notch sensor 49 outputs a different detection value to the controller 40 according to whether or not a notch K1 is present at the position corresponding to the location of the sensor.

The controller 40 detects if a notch K1 is present or is not present at the position of the sensor based on the detection value input from the notch sensor 49. More specifically, based on the detection value input from the notch sensor 49 during conveyance of the paper 14 (notched paper), the controller 40 calculates the label interval at which the labels are disposed by detecting the interval between adjacent notches K1. More specifically, as shown in FIG. 2D, while conveying the paper 14 (notched paper), the controller 40 counts the number of steps the conveyance motor 421 is required to drive between detection of one notch K1 and detection of the next notch K1 after the one notch K1 on the upstream side in the conveyance direction YJ1, and calculates the distance between one notch K1 and the next notch K1 based on the number of steps. Because the interval between notches K1 in this example is the same as the label interval between the corresponding labels S, the interval between detected notches K1 is the same as the label interval. Triggered by detecting a notch K1, the controller 40 continues calculating the label interval while conveying the paper 14 (notched paper).

The inkjet printer 5 in this embodiment of the invention enables selecting whether the black mark sensor 47, gap sensor 48, or notch sensor 49 is used. Using a specific means, the user changes the sensor that is used according to the type of paper 14 that is set in the inkjet printer 5.

As shown in FIG. 3, the host computer 1 has a host controller 60, host input unit 61, host display unit 62, host storage unit 63, and host communication unit 64.

The host controller 60 includes a CPU and controls the host computer 1. The host input unit 61 is connected to operating means such as input devices or input switches, detects operation of the operating means, and outputs to the host controller 60. The host display unit 62 has a display panel or other display means, and displays information on the display means as controlled by the host controller 60. The host storage unit 63 stores data. The host communication unit 64 communicates with the inkjet printer 5 according to a specific communication protocol as controlled by the host controller 60.

As described above, label paper having labels S affixed at a specific interval (FIGS. 2B, C, D) is used in the inkjet printer 5. The inkjet printer 5 prints images continuously to multiple labels S as controlled by the host computer 1. An image printed on one label S is referred to below as a label image.

Operation of the host computer 1 and the inkjet printer 5 when the inkjet printer 5 prints label images continuously to plural labels S as controlled by the host computer 1 is described below.

Figure 4:
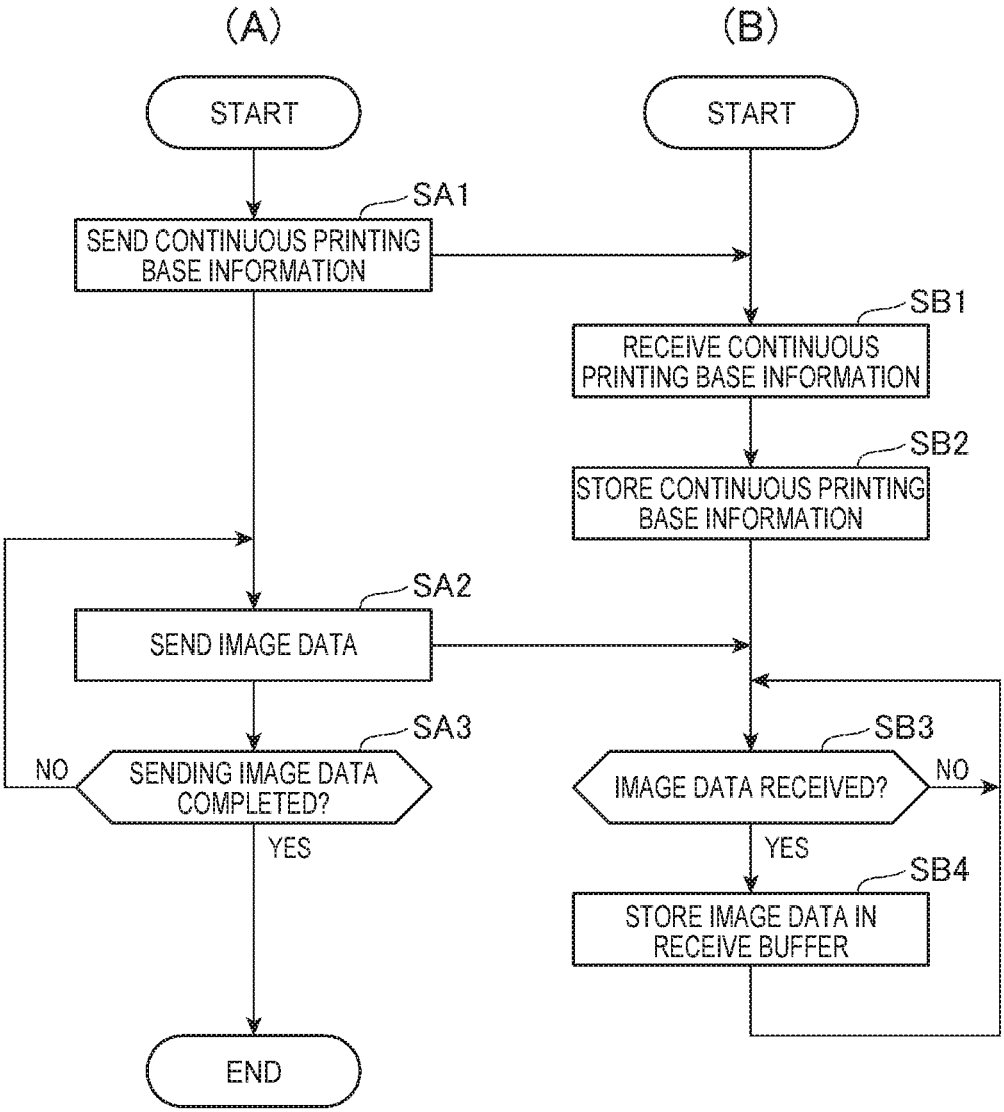
FIG. 4 is a flow chart of the operation of the host computer and inkjet printer.

FIG. 4 is a flow chart of the operation of the host computer 1 and the inkjet printer 5 when continuously printing images to multiple labels S. Column (A) of FIG. 4 shows the operation of the host computer 1, and (B) shows the operation of the inkjet printer 5.

As shown in column (A) of FIG. 4, to print label images on labels S, the host controller 60 of the host computer 1 generates and sends continuous printing base information to the inkjet printer 5 (step SA1).

Continuous printing base information is information required for continuous printing, that is, the inkjet printer 5 printing label images continuously to labels S. The continuous printing base information includes information indicating the number of labels S on which to print label images continuously.

The host controller 60 generates the continuous printing base information based on information input through a user interface provided by an application.

As shown in column (B) of FIG. 4, the controller 40 of the inkjet printer 5 receives the continuous printing base information (step SB1), and stores the received continuous printing base information in a specific storage area (step SB2).

As shown in column (A) of FIG. 4, after sending the continuous printing base information, the host controller 60 of the host computer 1 sends image data for the label image to print to one label S to the inkjet printer 5 (step SA2), and determines if transmission of image data for all label images to be printed on the labels S in continuously printing has been completed (step SA3). If transmission of image data for all label images to be printed on the labels S in continuously printing has not been completed, the host controller 60 returns to step SA2. If transmission of image data for all label images to be printed on the labels S in continuously printing has been completed, the host controller 60 ends the process.

In this way, the host computer 1 sends image data for the label images to be printed on the labels S in continuously printing.

As shown in column (B) of FIG. 4, the controller 40 of the inkjet printer 5 monitors if image data sent by the host computer 1 in step SA2 was received (step SB3).

If image data was received, the controller 40 stores the received image data in a receive buffer not shown (step SB4), and goes to step SB3.

In this way, the inkjet printer 5 receives image data for the label images to print on the labels S, and stores the image data for the label images in the order received in the receive buffer.

Based on the image data stored in the receive buffer, the controller 40 continuously prints the label images on multiple labels S.

Figure 5:
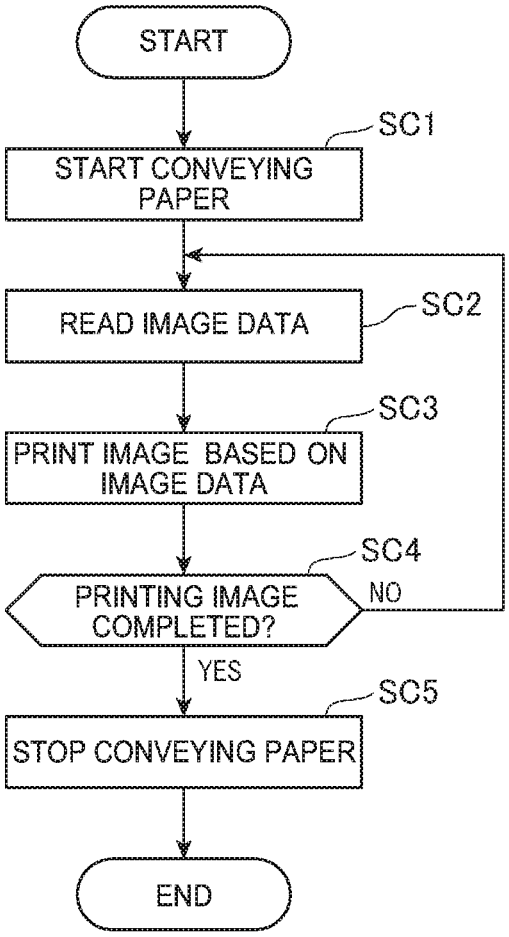
FIG. 5 is a flow chart of the operation of the inkjet printer.

FIG. 5 is a flow chart of the operation whereby the inkjet printer 5 continuously prints label images on multiple labels S based on the image data stored in the receive buffer.

As shown in FIG. 5, the controller 40 of the inkjet printer 5 that started printing label images controls the conveyance unit 42 to start conveying the paper 14 in the conveyance direction YJ1 (step SC1). After starting conveying the paper 14, the controller 40 accelerates conveyance until the conveyance speed of the paper 14 reaches a specific speed. The controller 40 then conveys the paper 14 while maintaining the conveyance speed at a specific speed. As described above, printing images on the paper 14 (printing label images on the labels S) proceeds while conveying the paper 14 in the conveyance direction YJ1 with the conveyance speed held at the specific speed.

While conveying the paper 14, the controller 40 manages adjusting the position of black marks BM, the leading edge Sa of labels S, or the position of the paper 14, and the position where printing starts, based on the detection value input from the black mark sensor 47, gap sensor 48, or notch sensor 49.

After starting to convey the paper 14, the controller 40 reads image data from the receive buffer (step SC2). Of the image data that has not been read from the receive buffer, the image data read in step SC2 is the image data that was stored first (earliest).

Next, based on the image data that was read, the controller 40 controls the print unit 41 and prints the label image on the corresponding label S (step SC3).

Next, the controller 40 determines based on the continuous printing base information if printing label images on all labels S to be printed continuously is finished (step SC4).

If printing label images on all labels S to be printed continuously is not finished (step SC4: NO), the controller 40 goes to step SC2.

If printing label images on all labels S to be printed continuously is finished (step SC4: YES), the controller 40 controls the conveyance unit 42 to stop conveying the paper 14 in the conveyance direction YJ1 (step SC5)• and ends the process.

Paper 14 that has been spliced may be set in the inkjet printer 5. Splicing means connecting two pieces of the same type of paper 14 together adhesively with tape or other means.

Figures 6A, 6B:
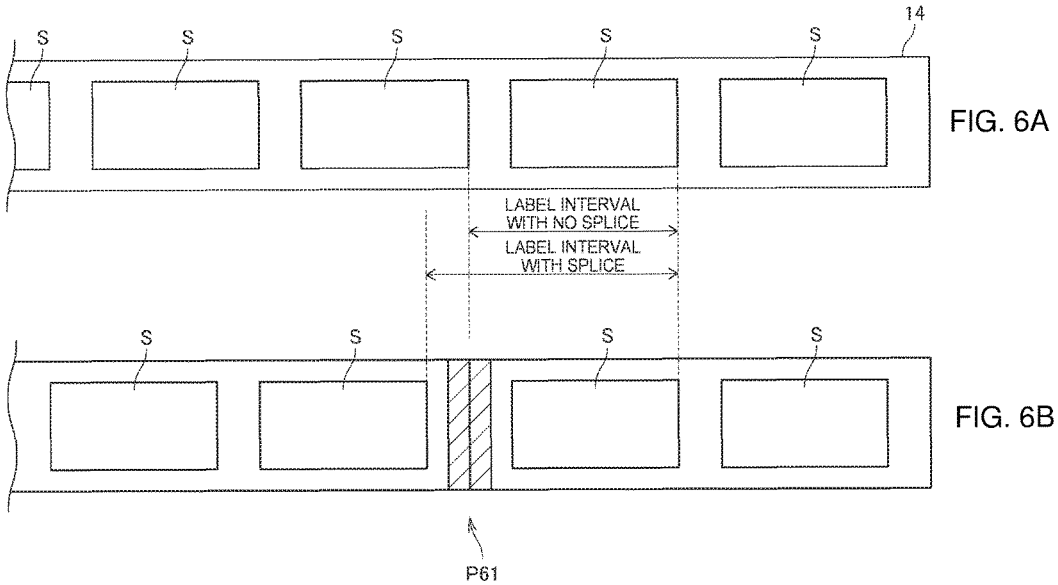
FIGS. 6A and 6B illustrate splicing paper.

FIG. 6A shows an example of the paper 14 (label paper) in FIG. 2B that has not been spliced. FIG. 6B shows an example of the paper 14 (label paper) in FIG. 2B that has been spliced.

In FIG. 6B, one length of paper 14 has been spliced with another length of the same type of paper 14 at a splice P61. As a result, the label interval between the adjacent labels on opposite sides of the splice P61 is longer than the normal label interval (the label interval where the paper 14 has not been spliced) of the paper 14 shown in FIG. 6A.

When the paper 14 is splices, the label interval (the mark interval if the paper 14 is black mark paper) in the area that was spliced is longer than the normal label interval (the mark interval if the paper 14 is black mark paper).

Because paper 14 that has been spliced may be set, the inkjet printer 5 according to this embodiment executes the process described below while conveying paper 14.

Figure 7:
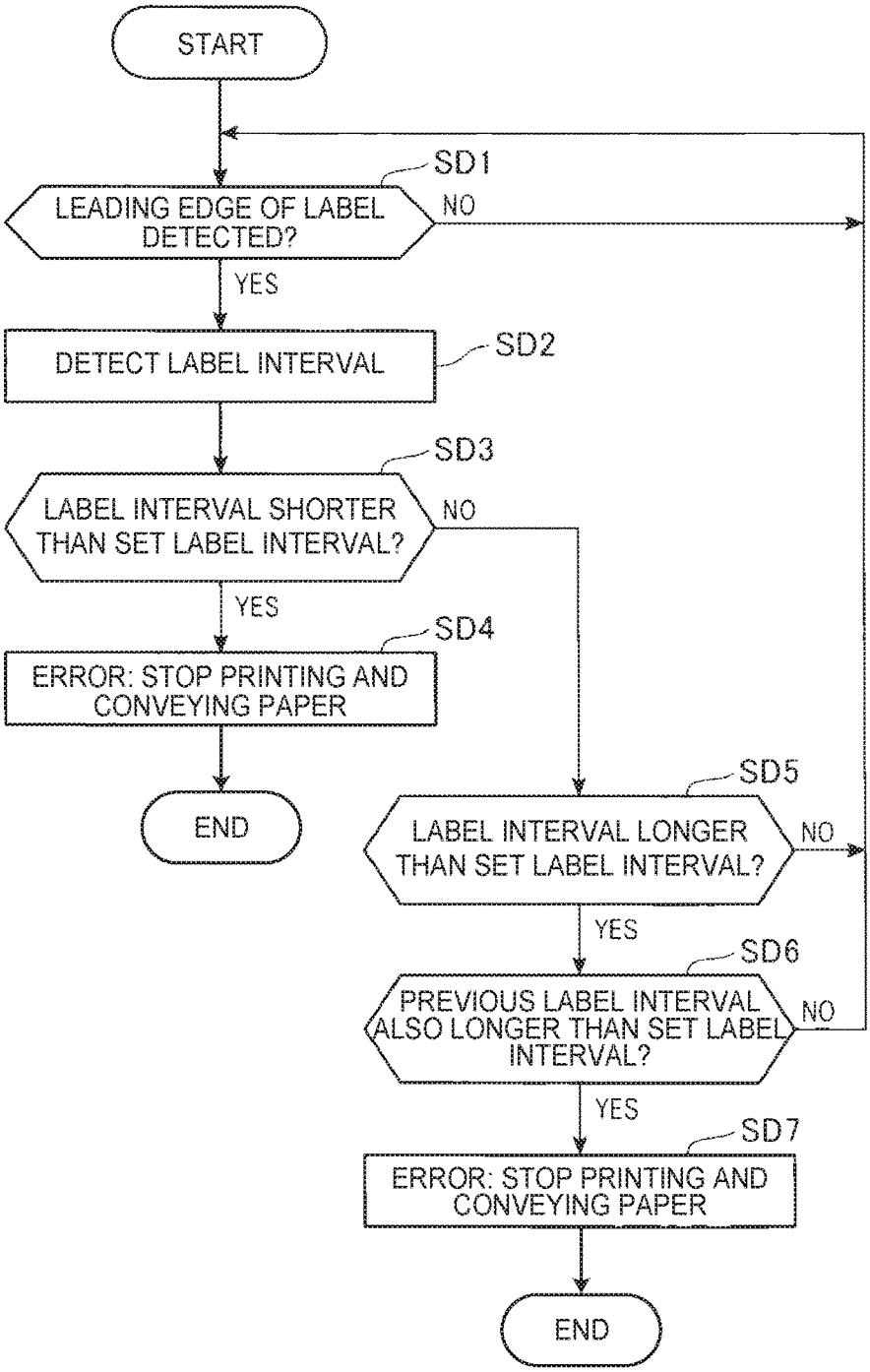
FIG. 7 is a flow chart of the operation of the inkjet printer.

FIG. 7 is a flow chart of a process the inkjet printer 5 executes while conveying paper 14.

The operation shown in the flow chart in FIG. 7 describes the operation when paper 14 (label paper) such as shown in FIG. 2B is set in the inkjet printer 5 and the gap sensor 48 is used as the sensor.

The inkjet printer 5 executes the process shown in the flowchart in FIG. 7 between starting conveyance of the paper 14 in step SC1 in the flow chart in FIG. 5, and stopping conveyance in step SC5.

As shown in FIG. 7, while conveying the paper 14, the controller 40 of the inkjet printer 5 monitors based on the detection value input from the gap sensor 48 if the leading edge Sa of a label S was detected (step SD1).

If the leading edge Sa of a label S was detected (step SD1), the controller 40 counts the number of steps the conveyance motor 421 (a stepper motor) must drive to convey the paper 14 from the leading edge Sa of the label S detected one before to the leading edge Sa of the next label Sin step SD1, and calculates the label interval (step SD2). The number of steps the controller 40 detects in step SD2 corresponds to the label interval. Note that the controller 40 counts the number of steps from detection of one leading edge Sa until detection of the next leading edge Sa upstream in the conveyance direction YJ1 from the one leading edge Sa.

Next, the controller 40 determines if the label interval detected in step SD2 is shorter than the set label interval (specified length) previously set as the label interval of the paper 14 set in the inkjet printer 5 (step SD3).

This set label interval is the value previously set by the user.

As described above, the inkjet printer 5 has an input unit 43 that detects and outputs operation of an operating switch disposed to the inkjet printer 5 to the controller 40. In this embodiment of the invention, the user operates the operating switch to set a value corresponding to the type of paper 14 set in the inkjet printer 5. The controller 40 acquires the value specified by the user based on the input from the input unit 43, and saves the value as the set label interval.

In this embodiment, the user operates an operating switch of the printer to save the set label interval in the inkjet printer 5, but the set label interval may be set based on a control command received from the host computer 1 or other device connected to the inkjet printer 5. In this event, information input to the device that generates the control command may simply be the information required to generate the control command.

Further alternatively, the inkjet printer 5 may convey the paper 14 a specific amount when the paper 14 is loaded, and the label interval calculated from the leading edges Sa or black marks BM detected during this conveyance may be saved as the set label interval.

By whatever method the set label interval is set, the set label interval is a value indicating the label interval of the paper 14 that is actually loaded in the inkjet printer 5.

If in step SD3 the controller 40 determines the label interval calculated in step SD2 is shorter than the set label interval (step SD3: YES), it determines an error occurred and executes an error handling process of stopping conveying the paper 14 and printing images on the paper 14 (step SD4), and ends the process.

Note that the value of the set label interval compared in step SD3 with the value of the label interval calculated in step SD2 is a value that reflects in the set label interval a margin of error introduced in the calculation of the label interval, for example.

The calculated label interval may be determined to be shorter than the set label interval in step SD3 in the following two cases. First, an error related to conveyance of the paper 14 occurred, and a label interval shorter than the value that was set as the set label interval due to the conveyance-related error was calculated. Second, there is a difference between the label interval of the paper 14 recognized by the user, and the label interval of the paper 14 set in the inkjet printer 5, and paper 14 with a shorter label interval than the value that was set as the set label interval is conveyed. Because images cannot be printed normally in either case, the controller 40 determines in step SD4 that an error occurred, and stops conveying the paper 14 and printing images on the paper 14 as the error handling process.

If in step SD3 the controller 40 determines the label interval calculated in step SD2 is not shorter than the set label interval that was set (step SD3: NO), the controller 40 determines if the label interval calculated in step SD2 is longer than the set label interval that was previously set (step SD5).

Note that the value of the set label interval compared in step SD3 with the value of the label interval calculated in step SD2 is a value that reflects in the set label interval a margin of error introduced in the calculation of the label interval, for example.

If in step SD5 the controller 40 determines the label interval calculated in step SD2 is not longer than the set label interval that was previously set (step SD5: NO), in other words, if the calculated label interval and the set label interval that was set are the same, control returns to step SD1. If the label interval calculated in step SD2 and the set label interval are the same, this is likely because an error has not occurred. Note that because the value of the label interval calculated in step SD2 and the value of the set label interval with which it is compared in step SD3 and step SD5 are values reflecting a margin of error in the set label interval, the calculated label interval and the set label interval are determined to be the same if the value of the calculated label interval is within a specific range of the value of the set label interval including the margin.

If in step SD5 the controller 40 determines the label interval calculated in step SD2 is longer than the set label interval that was set (step SD5: YES), the controller 40 determines if the label interval calculated in step SD2 the last (previous) time step SD2 was executed is longer than the set label interval (step SD6). More specifically, in step SD6 the controller 40 determines if a label interval longer than the set label interval (specific length) was calculated twice consecutively. Note that each time the label interval is calculated in step SD2, the controller 40 stores the calculated label interval in a specific storage area.

If in step SD6 the controller 40 determines the label interval calculated in step SD2 the last (previous) time step SD2 was executed is longer than the set label interval (step SD6: YES), in other words, if a label interval longer than the set label interval (specific length) was calculated twice consecutively, the controller 40 determines an error occurred, and stops conveying the paper 14 and printing images on the paper 14 as the error handling process (step SD7).

The calculated label interval may be determined to be longer than the set label interval twice consecutively in the following two cases. First, an error related to conveyance of the paper 14 occurred, and a label interval longer than the value that was set as the set label interval due to the conveyance-related error was calculated twice consecutively. Second, there is a difference between the label interval of the paper 14 recognized by the user, and the label interval of the paper 14 set in the inkjet printer 5, and paper 14 with a longer label interval than the value that was set as the set label interval is conveyed. Because images cannot be printed normally in either case, the controller 40 determines in step SD7 that an error occurred, and stops conveying the paper 14 and printing images on the paper 14 as the error handling process.

If in step SD2 the controller 40 determines the label interval calculated in step SD2 the last (previous) time step SD2 was executed is not longer than the set label interval (step SD6: NO), the controller 40 returns to step SD1. As a result, if a label interval longer than the set label interval is not calculated twice consecutively, that is, if a label interval longer than the set label interval is calculated (step SD5: YES) but the label interval calculated last time is the same as the set label interval (step SD6: NO), conveyance of the paper 14 and printing on the paper 14 do not stop, and the process of conveying the paper 14 and printing on the paper 14 continues.

If a label interval longer than the set label interval is detected only once and not consecutively, the inkjet printer 5 in this example applies control assuming that the paper 14 set in the inkjet printer 5 is spliced label paper. More specifically, spliced label paper has a label interval corresponding to the splice (FIGS. 6A and 6B) that is longer than the normal label interval where the paper is not spliced. As a result, when the controller 40 detects a label adjacent to the splice, it calculates a label interval that is longer than the set label interval. If the calculated label interval is determined to be longer than the set label interval because of a conveyance-related error or a difference between the set label interval and the label interval of the paper 14 that is actually loaded, a label interval determined to be longer than the set label interval will be calculated consecutively. It may therefore be inferred that step SD6 deciding that the calculated label interval is longer than the set label interval is because a label adjacent to a splice was detected. Because printing images to the paper 14 can continue normally in this event, an error is determined to have occurred, and conveying the paper 14 and printing to the paper 14 continues instead of executing a process of stopping conveying the paper 14 and printing to the paper 14. A sa result, printing is not stopped unnecessarily, throughput can be improved and user convenience can be improved.

The operation of the inkjet printer 5 when label paper is conveyed is described in the flow chart in FIG. 7, but when black mark paper is conveyed, a set mark interval (specific length) that is equivalent to the set label interval is previously set, and the equivalent process can be executed.

As described above, a inkjet printer 5 (printing device) according to this embodiment has a conveyance unit 42 configured to convey label paper having labels S affixed at a specific interval to a liner in a conveyance direction YJ1, and an inkjet line head 12 (printhead) configured to print on the label paper conveyed by the conveyance unit 42. The inkjet printer 5 detects the leading edge Sa of labels by a sensor disposed to the conveyance path L while the conveyance unit 42 conveys the label paper, and calculates the label interval, which is the interval at which adjacent labels S are affixed on the label paper. When a label interval shorter than the set label interval (specific length) is calculated, the inkjet printer 5 determines an error occurred and stops the process. When a label interval longer than the set label interval (specific length) is calculated, and the label interval that was calculated the last time is the set label interval, the inkjet printer 5 does not determine an error occurred and continues the process. When a label interval longer than the set label interval is calculated, and the label interval that was calculated the last time is also longer than the set label interval, the inkjet printer 5 determines an error occurred and stops the process.

When a label interval longer than the set label interval is calculated based on detection because the paper was spliced, this configuration can prevent stopping printing unnecessarily and a drop in throughput. More specifically, this configuration enables an inkjet printer 5 that conveys and prints on label paper to execute a process appropriate to conveying paper 14 that has been spliced.

The inkjet printer 5 in this embodiment sets a set label interval according to a command from operation of an operating switch or a control command from an external device, or calculates the label interval by a specific process and sets the calculated label interval as the set label interval.

This configuration enables the setting a set label interval of an appropriate value.

In the inkjet printer 5 according to this embodiment, the inkjet line head 12 (printhead) is located downstream in the conveyance direction YJ1 from the sensors. The inkjet printer 5 prints with the inkjet line head 12 while conveying label paper or black mark paper in the conveyance direction YJ1 by the conveyance unit 42, and calculates the label interval or mark interval by optically detecting the leading edge Sa (edge) of the labels S on the liner with a sensor.

This configuration enables the inkjet printer 5 to accurately detect the label interval or mark interval while printing images on the paper 14 and conveying the paper 14 in conjunction with printing images.

The invention is described above with reference to a preferred embodiment thereof, but the invention is not limited thereto and can be modified and adapted in many ways without departing from the scope of the accompanying claims.

For example, the label interval or mark interval are calculated in the foregoing embodiment from the number of steps the conveyance motor 421, which is a stepper motor, is driven, but the invention is not so limited. For example, if the conveyance motor 421 is not a stepper motor, such as a brushless DC motor, the controller 40 may be configured to detect rotation of a conveyance roller 16 using a rotary encoder, and calculate the label interval based on the output of the rotary encoder.

The configuration of the inkjet line head 12 is also not limited to the configuration shown in FIG. 1, and may be desirably configured. Other types of line heads, such as a thermal line head, may also be used.

The function blocks described above with reference to the figures can be embodied as desired by the cooperation of hardware and software, and do not suggest a specific hardware configuration.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A control method of a printing device having a conveyance roller that conveys paper having detected parts at a specific interval in a conveyance direction, and a printhead that prints on the paper conveyed by the conveyance roller, comprising:

detecting the detected parts of the paper and calculating the interval between the detected parts while the paper is conveyed by the conveyance roller;

detecting an error and executing an error handling process when an interval shorter than a specified length is calculated;

comparing the previously calculated interval with the specified length when the calculated interval is longer than the specified length;

not determining an error occurred when the previously calculated interval is the same as the specified length; and determining an error occurred and executing an error handling process when the previously calculated interval is longer than the specified length.

2. The control method of a printing device described in claim 1, the paper being label paper having multiple labels affixed to a liner; and detecting a label edge on one side in the conveyance direction of the label as the detected parts, and calculating the label interval as the interval.

3. The control method of a printing device described in claim 1, the paper being black mark paper having printed marks; and detecting an edge on one side of the marks in the conveyance direction as the detected parts, and calculating the mark interval as the interval.

4. The control method of a printing device described in claim 1, the specified length being set according to a command from operation of an operating switch disposed to the printing device.

5. The control method of a printing device described in claim 1, the specified length being set according to a control command from an external device.

6. The control method of a printing device described in claim 1, further comprising:

conveying the paper a specific distance, calculating the interval based on the detected parts detected during conveyance, and setting the calculated interval as the specified length.

7. The control method of a printing device described in claim 1, the printhead being disposed downstream from the sensor in the conveyance direction; and printing with the printhead and detecting the interval while conveying the paper in the conveyance direction by the conveyance roller.

8. A printing device comprising:

a conveyance roller configured to convey paper having detected parts at a specific interval in a conveyance direction;

a printhead configured to print on the paper conveyed by the conveyance roller;

a sensor disposed on the conveyance path; and a controller configured to control the sensor while conveying the paper by the conveyance roller, calculate the interval between the detected parts of the paper based on detection, detecting an error when an interval shorter than a specified length is calculated, compare the previously calculated interval with the specified length when the calculated interval is longer than the specified length, not determine an error occurred when the previously calculated interval is the same as the specified length, and determine an error occurred and execute an error handling process when the previously calculated interval is longer than the specified length.

* * * * *